US009945561B2

(12) United States Patent
Eroglu et al.

(10) Patent No.: US 9,945,561 B2
(45) Date of Patent: Apr. 17, 2018

(54) GAS TURBINE PART COMPRISING A NEAR WALL COOLING ARRANGEMENT

(71) Applicant: ANSALDO ENERGIA IP UK LIMITED, London (GB)

(72) Inventors: Adnan Eroglu, Untersiggenthal (CH); Michael Thomas Maurer, Bad Säckingen (DE); Diane Lauffer, Wettingen (CH)

(73) Assignee: ANSALDO ENERGIA IP UK LIMITED, London (GB)

( * ) Notice: Subject to any disclaimer, the term of this patent is extended or adjusted under 35 U.S.C. 154(b) by 378 days.

(21) Appl. No.: 14/091,621

(22) Filed: Nov. 27, 2013

(65) Prior Publication Data

US 2014/0150436 A1 Jun. 5, 2014

(30) Foreign Application Priority Data

Nov. 30, 2012 (EP) ..... 12195165

(51) Int. Cl.

| | |
|---|---|
| ***F23R 3/00*** | (2006.01) |
| ***F23R 3/06*** | (2006.01) |
| ***F23M 5/08*** | (2006.01) |
| ***F01D 25/12*** | (2006.01) |

(52) U.S. Cl.

CPC ..... *F23R 3/002* (2013.01); *F01D 25/12* (2013.01); *F23M 5/085* (2013.01); *F23R 3/005* (2013.01); *F23R 3/06* (2013.01); *F05D 2260/20* (2013.01); *F05D 2260/201* (2013.01); *F23R 2900/03043* (2013.01)

(58) Field of Classification Search

CPC .. F23R 3/002; F23R 3/06; F23R 2900/03043; F23R 2900/03045; F01D 25/12; F05D 2260/20; F05D 2260/201

See application file for complete search history.

(56) References Cited

U.S. PATENT DOCUMENTS

| | | | | |
|---|---|---|---|---|
| 4,339,925 | A * | 7/1982 | Eggmann | F01D 25/26 60/757 |
| 5,388,412 | A | 2/1995 | Schulte-Werning et al. | |
| 5,647,202 | A | 7/1997 | Althaus | |

(Continued)

FOREIGN PATENT DOCUMENTS

| | | |
|---|---|---|
| EP | 0 203 431 | 12/1986 |
| EP | 2 169 314 | 3/2010 |

(Continued)

*Primary Examiner* — Gerald L Sung
*Assistant Examiner* — Scott Walthour
(74) *Attorney, Agent, or Firm* — Buchanan Ingersoll & Rooney PC

(57) ABSTRACT

A gas turbine combustor part of a gas turbine includes a wall, containing a plurality of near wall cooling channels extending essentially parallel to each other in a first direction within the wall in close vicinity to the hot side and being arranged in at least one row extending in a second direction. The near wall cooling channels are each provided at one end with an inlet for the supply of cooling air, and on the other end with an outlet for the discharge of cooling air. The inlets open into a common feeding channel for cooling air supply, and the outlets open into a common discharge channel for cooling air discharge. The feeding channel and the discharge channel extend in the second direction.

10 Claims, 3 Drawing Sheets

(56) References Cited

U.S. PATENT DOCUMENTS

| | | | | |
|---|---|---|---|---|
| 6,374,898 | B1 | 4/2002 | Vogeler et al. | |
| 6,981,358 | B2 | 1/2006 | Bellucci et al. | |
| 2001/0016162 | A1 | 8/2001 | Lutum et al. | |
| 2002/0078691 | A1 | 6/2002 | Hoecker | |
| 2008/0276619 | A1 | 11/2008 | Chopra et al. | |
| 2009/0120094 | A1 | 5/2009 | Norster | |
| 2010/0282721 | A1* | 11/2010 | Bunker | F01D 25/12 219/121.61 |
| 2011/0255989 | A1* | 10/2011 | Koyabu | F01D 11/24 416/97 R |
| 2012/0036858 | A1 | 2/2012 | Lacy et al. | |
| 2012/0111012 | A1 | 5/2012 | Axelsson et al. | |
| 2012/0159954 | A1* | 6/2012 | Ito | F01D 9/023 60/752 |
| 2013/0025287 | A1* | 1/2013 | Cunha | F23R 3/002 60/772 |

FOREIGN PATENT DOCUMENTS

| | | |
|---|---|---|
| EP | 2 295 864 | 3/2011 |
| WO | 2004/035992 | 4/2004 |

* cited by examiner

GAS TURBINE PART COMPRISING A NEAR WALL COOLING ARRANGEMENT

CROSS-REFERENCE TO RELATED APPLICATIONS

This application claims priority to European application 12195165.1 filed Nov. 30, 2012, the contents of which are hereby incorporated in its entirety.

TECHNICAL FIELD

The present invention relates to the field of gas turbines, in particular to combustion systems of gas turbines, which have to be properly cooled in order to ensure a sufficient lifetime, but at the same time are subject to strict regulations of emissions.

This invention applies to convective cooling schemes.

It refers to a gas turbine part according to the preamble of claim 1.

BACKGROUND

In order to achieve a high efficiency, a high turbine inlet temperature is required in standard gas turbines. As a result, there arise high NOx emission levels and higher life cycle costs. These problems are mitigated with a sequential combustion cycle, wherein the compressor delivers nearly double the pressure ratio of a conventional one.

The main flow passes the first combustion chamber (e.g. EV combustor), wherein a part of the fuel is combusted. After expanding at the high-pressure turbine stage, the remaining fuel is added and combusted (e.g. SEV combustor). Since the second combustor is fed by expanded exhaust gas of the first combustor, the operating conditions allow self-ignition (spontaneous ignition) of the fuel/air mixture without additional energy being supplied to the mixture (see for example document EP 2 169 314 A2).

Currently convective cooling is used in several combustor parts, e.g. in both the EV and SEV liners. As shown in FIG. 1(*a*), the cooling air flow 23 of such a combustor part 20 is routed in a cooling channel 22 along the wall 21 to be cooled, and the cooling efficiency can be improved by applying rib turbulators on the wall.

An alternative that can require less cooling air is a combustor part 24 shown in FIG. 1(*b*) with the application of many small cooling channels 27 (situated between an outer plate 25 and an inner plate 26 of the wall, which channels are situated much closer to the hot side (lower side in FIG. 1). In these channels a higher heat-pick-up can be reached with less cooling mass flow, thus increasing the cooling efficiency. In consequence, less total cooling mass flow is needed, which has a positive impact on the gas turbine performance and emissions.

In the related prior art, several solutions have been proposed with regard to gas turbine combustors:

Document EP 2 295 864 A1 discloses a combustion device for a gas turbine, which shows channels near the wall of the combustion chamber, and which comprises a portion provided with a first and a second wall provided with first passages connecting the zone between the first and second wall to the inner of the combustion device and second passages connecting said zone between the first and second wall to the outer of the combustion device. Between the first and second wall a plurality of chambers are defined, each connected with one first passage and at least one second passage, and defining a Helmholtz damper.

Document U.S. Pat. No. 6,981,358 B2 discloses a reheat combustion system for a gas turbine comprising a mixing tube adapted to be fed by products of a primary combustion zone of the gas turbine and by fuel injected by a lance; a combustion chamber fed by the said mixing tube; and at least one perforated acoustic screen. The acoustic screen is provided inside the mixing tube of the combustion chamber, at a position where it faces, but is spaced from, a perforated wall thereof. In use, the perforated wall experiences impingement cooling as it admits air into the combustion system for onward passage through the perforations of the said acoustic screen, and the acoustic screen damps acoustic pulsations in the mixing tube and combustion chamber.

Document US 2001/0016162 A1 teaches a cooled blade for a gas turbine, in which blade a cooling fluid, preferably cooling air, flows for convective cooling through internal cooling passages located close to the wall and is subsequently deflected for external film cooling through film-cooling holes onto the blade surface, and the fluid flow is directed in at least some of the internal cooling passages in counterflow to the hot-gas flow flowing around the blade, homogeneous cooling in the radial direction is achieved owing to the fact that a plurality of internal cooling passages and film-cooling holes are arranged one above the other in the radial direction in the blade in such a way that the discharge openings of the film-cooling holes in each case lie so as to be offset from the internal cooling passages, in particular lie between the internal cooling passages.

Document WO 2004/035992 A1 discloses a component capable of being cooled, for example a combustion chamber wall segment whereof the walls of the cooling channel include projecting elements of specific shape selectively arranged. The height of the projecting elements ranges between 2% and 5% of the hydraulic diameter of the cooling channel. Thus, the elements are just sufficiently high to generate a turbulent transverse exchange with the central flow in the laminar lower layer, next to the wall, of a cooling flow with fully developed turbulence, thereby considerably enhancing the heat transfer next to the wall of the cooling side without significantly increasing pressure drop in the cooling flow through influence of the central flow.

Document U.S. Pat. No. 5,647,202 teaches a cooled wall part having a plurality of separate convectively cooled longitudinally cooling ducts running near the inner wall and parallel thereto, adjacent longitudinal cooling ducts being connected to one another in each case via intermediate ribs. There is provided at the downstream end of the longitudinal cooling ducts a deflecting device which is connected to at least one backflow cooling duct which is arranged near the outer wall in the wall part and from which a plurality of tubelets extend to the inner wall of the cooled wall part and are arranged in the intermediate ribs branch off. By means of this wall part, the cooling medium can be put to multiple use for cooling (convective, effusion, film cooling).

Document U.S. Pat. No. 6,374,898 B1 discloses a process for producing a casting core which is used for forming within a casting a cavity intended for cooling purposes, through which a cooling medium can be conducted, the casting core having surface regions in which there is incorporated in a specifically selective manner a surface roughness which transfers itself during the casting operation to surface regions enclosing the cavity and leads to an increase in the heat transfer between the cooling medium and the casting.

However, when implementing a near wall cooling channel design on large surfaces, such as for example combustor liners, it is a challenge to assure the feeding and discharging of all near wall channels with cooling air. An example is sketched in FIG. 2: In the gas turbine part 10*a* of FIG. 2 a feeding channel 12 with an outer channel wall 13*a* and a separation wall 13 as an inner wall supplies all small cooling channels 15, which run parallel to each other are arranged in a row extending along a predetermined direction, with cooling air. The supplied cooling air 18 enters the feeding channel 12 at one end, enters the cooling channels 15 through their inlets 16, flows through the cooling channels 15, which are embedded in the wall 11 to be cooled, and afterwards, the air enters a discharge channel 14 through cooling channel outlets 17, which discharge channel 14 with its outer wall 13*b* needs to be separated from the feeding channel 12 by means of the common separation wall 13. From there it is discharged (discharged cooling air 19). On a large surface, e.g. on the liners, several of these elements can be situated next to each other (see FIG. 5).

Since part of the cooling air is fed through each near wall cooling channel 15 (see arrows through the cooling channels in FIG. 2), the remaining cooling mass flow in the feeding channel 12 is decreasing in flow direction. This has a direct impact on the flow velocity and consequently on the static pressure distribution, which is also decreasing along the feeding channel 12. In the discharge channel 14, this effect is reversed: The cooling mass flow and velocity are increasing in flow direction, consequently also increasing the static pressure. Because of these pressure distributions the pressure difference within the near wall channels 15 of one row (from inlet to outlet) is changing along the cooling path and therefore influences the cooling mass flow going through each channel.

However, for a constant cooling performance in all near wall channels it is desirable to have the same mass flow in all channels.

SUMMARY

It is an object of the present invention to optimize the cooling efficiency and thus reduce cooling air consumption and/or reduce emissions.

This object is obtained by a gas turbine part according to claim 1.

The gas turbine part according to the invention, which is especially a combustor part of a gas turbine, comprises a wall, which is subjected to high temperature gas on a hot side and comprises a near wall cooling arrangement, with the wall containing a plurality of near wall cooling channels extending essentially parallel to each other in a first direction within the wall in close vicinity to the hot side and being arranged in at least one row extending in a second direction essentially perpendicular to said first direction, whereby said near wall cooling channels are each provided at one end with an inlet for the supply of cooling air, and on the other end with an outlet for the discharge of cooling air, whereby said inlets open into a common feeding channel for cooling air supply, and said outlets open into a common discharge channel for cooling air discharge, said feeding channel and said discharge channel extending in said second direction, said feeding channel being open at a first end to receive supplied cooling air and guide it the row of cooling channel inlets, and said discharge channel being open at a second end to discharge cooling air from the row of cooling air outlets.

It is characterized in that means are provided within said near wall cooling arrangement to equalize the cooling air mass flow through the near wall cooling channels having a common feeding channel and/or discharge channel.

According to an embodiment of the invention all near wall cooling channels of said near wall cooling arrangement have essentially the same cross section.

According to another embodiment of the invention all near wall cooling channels of said near wall cooling arrangement are arranged within said row with an essentially constant inter-channel distance.

Specifically, the feeding channel has a cross section, which decreases in the second direction with increasing distance from said first end.

More specifically, the discharge channel has a cross section, which increases in the second direction with decreasing distance from said second end.

Preferably, the variation of the cross section with distance is linear.

Specifically, the feeding channel and the discharge channel are separated by a common separation wall, that the cross sections of the feeding channel and the discharge channel are each defined by said common separation wall and a respective outer channel wall, and that the variation of the cross section in the second direction is effected by an oblique orientation between the common separation wall and the outer channel walls.

More specifically, the direction of the common separation wall is parallel to the second direction, and that the directions of the outer channel walls are oblique with respect to the second direction.

Alternatively, the direction of the common separation wall, and that the directions of the outer channel walls are parallel to the second direction, and that the direction of the common separation wall is oblique with respect to the second direction.

According to just another embodiment of the invention, the feeding channel and the discharge channel each have a constant cross section in the second direction, and that the number of cooling channels per unit length in the second direction decreases from the first end to the second end.

According to a further embodiment of the invention the feeding channel and the discharge channel each have a constant cross section in the second direction, and that the cross section of the cooling channels decreases in the second direction from the first end to the second end.

According to another embodiment of the invention the near wall cooling arrangement comprises a plurality of rows of near wall cooling channels, that the rows run parallel to each other in the second direction, and that each of said rows has a separate feeding channel and discharge channel with a common separation wall and respective outer channel walls, and that neighbouring rows share an outer channel wall.

BRIEF DESCRIPTION OF THE DRAWINGS

The present invention is now to be explained more closely by means of different embodiments and with reference to the attached drawings.

DETAILED DESCRIPTION

Within the present invention and its equalizing means several ways to optimize and control the cooling performance are described.

Figure 3:
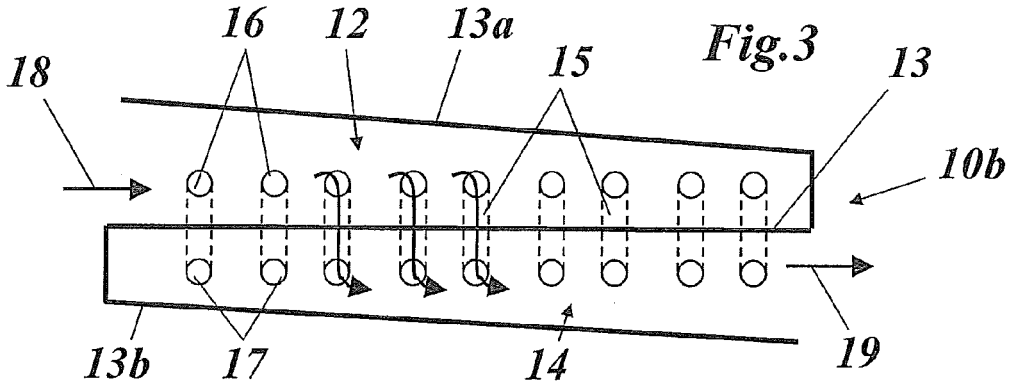
FIG. 3 shows in a top view feeding and discharge channels with changing cross sections according to one embodiment of the invention (with oblique channel outer walls)

One way is to provide feeding and discharge channels with changing cross sections:

As sketched in FIG. 3, the cross sections of the feeding and discharge channels 12 and 14, respectively, of a gas turbine part 10*b* can be adjusted along the cooling path. This is done by choosing the separation wall 13 of the two channels 12 and 14 to be strictly parallel to the extending longitudinal direction of the row of cooling channels 15, while the outer channel wall s 13*a* and 13*b* have an oblique orientation with respect to this direction such that the feeding channel narrows in this direction, while the discharge channel 14 widens respectively. In the example of FIG. 3, this narrowing and widening is linear with the distance in the longitudinal direction of the row.

Figure 1:
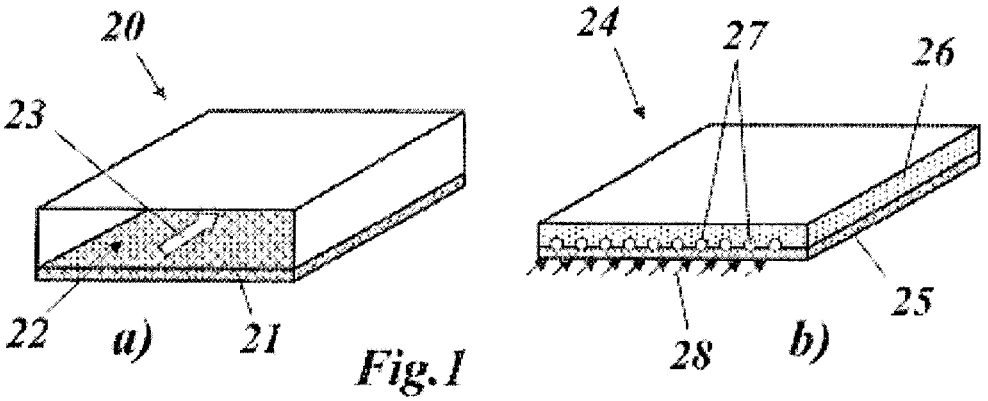
Fig.1 PRIOR ART
FIG. 1 shows a conventional convective cooling design (a) and a near wall cooling design (b)
Figure 2:
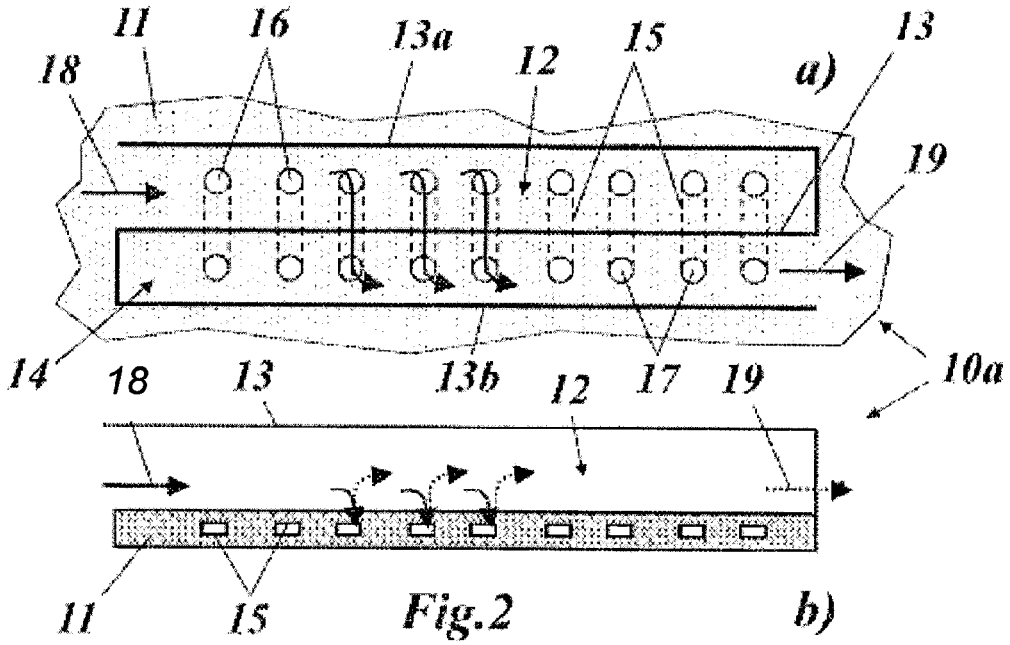
Fig.2 PRIOR ART
FIG. 2 shows in general the feeding and discharging of near wall cooling channels, e.g. in a combustor liner application in a top view (a) and side view (b)

In this way, the pressure distribution can be influenced and therefore the mass flow entering the near wall cooling channels 15 can be controlled. Like in the case with constant cross sections (FIG. 2) several of these segments can be situated next to each other in order to cover large cooling surfaces (see FIG. 5).

Figure 4:
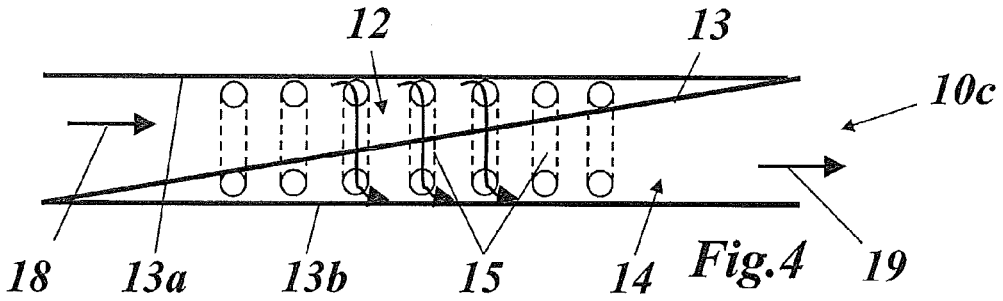
FIG. 4 shows in a top view feeding and discharge channels with changing cross sections according to another embodiment of the invention (with oblique common separation wall)
Figure 5:
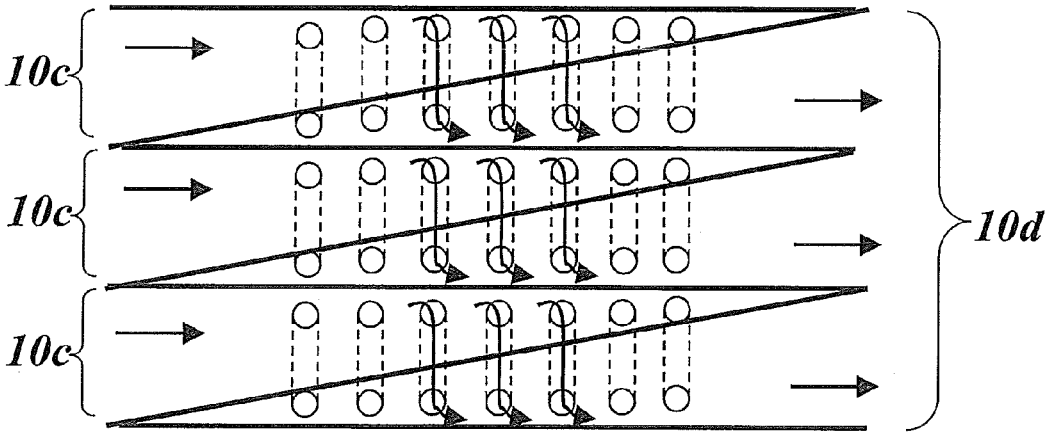
FIG. 5 shows in a top view a combustor liner application with plural adjacent rows of cooling channels and feeding and discharge channels with changing cross sections according to a further embodiment of the invention.

An equivalent variation in cross section can be achieved by the configuration shown in FIG. 4. Here, in gas turbine part 10*c*, the common separation wall 13 has an oblique orientation, while the outer channel walls 13*a* and 13*b* are oriented strictly parallel to the longitudinal direction of the row. This has the advantage that it allows directly a combustor liner application (combustor part 10*d*) by simply adding a plurality of such elements in parallel, as shown in FIG. 5.

Figure 6:
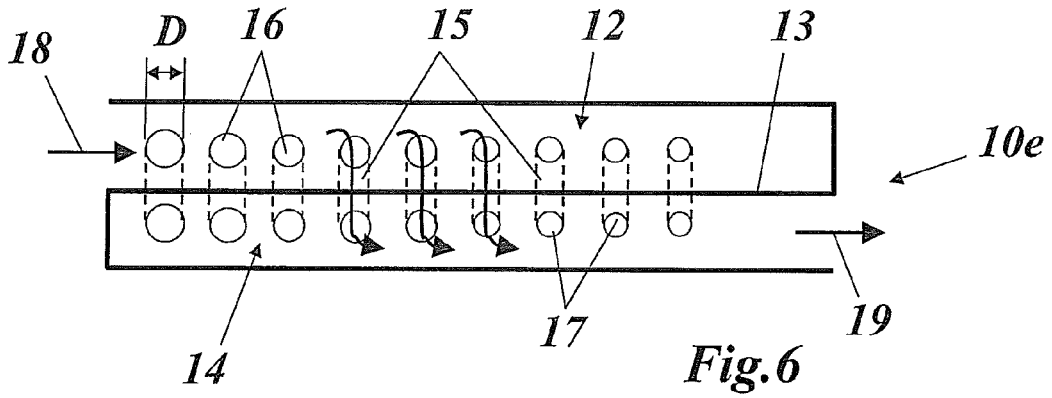
FIG. 6 shows in a top view near-wall cooling channels with varying inlet and outlet hole diameter according to another embodiment of the invention.

Another way to control and optimize the coolant mass flow through the individual near-wall cooling channels 15 is according to the combustor part 10*e* of FIG. 6 to vary the inlet and outlet diameters D of the near-wall cooling channels 15, while the cross sections of the feeding and discharge channels 12 and 14 may kept constant in the longitudinal direction. However, a combination of varying feeding and discharge channel cross section and varying diameter D of the cooling channels 15 is also possible.

Figure 7:
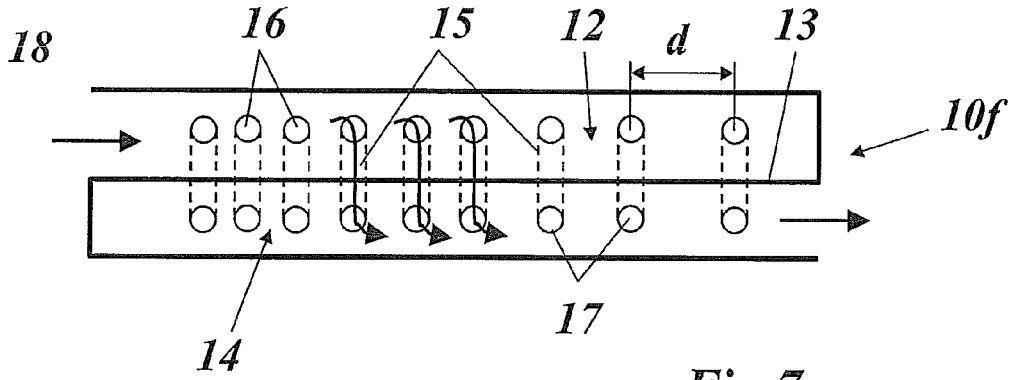
FIG. 7 shows in a top view near-wall cooling channels with varying spacing in the direction of the row according to just another embodiment of the invention.

Despite controlling the mass flow rate through the individual near-wall cooling channels 15, it is also possible to optimize the spacing of the near-wall cooling channels 15 in longitudinal direction of the row (FIG. 7). At the feeding channel inlet of combustor part 10*f*, where due to the variation in static pressure, the coolant mass flow is lower, a denser arrangement of near-wall cooling channels 15 is applied to compensate the lower mass flow rates. However, a combination of varying feeding and discharge channel cross section and/or varying diameter D of the cooling channels 15 with a varying distribution density of the cooling channels in longitudinal direction is also possible.

The characteristics and advantages of the invention are the following:

- Optimization of local cooling performance by adjusting the channel cross sections of the feeding and discharge channels as well as inlet and outlet diameters (D) of the cooling channels and/or their distribution density in longitudinal direction.
- Reduction of cooling air leads to reduction of necessary flame temperature and reduction of emissions.
- If less total cooling air is needed, the gas turbine efficiency can be increased.

The invention claimed is:

1. A combustor part of a gas turbine, comprising:

a wall, which is subjected to high temperature gas on a hot side, the wall containing a plurality of near wall cooling channels extending essentially parallel to each other in a first direction within the wall in close vicinity to the hot side and being arranged in at least one row extending in a second direction essentially perpendicular to the first direction, the at least one row having a first end and a second end, and wherein the plurality of near wall cooling channels are each provided at one end with an inlet for a supply of cooling air, and on another end with an outlet for a discharge of cooling air, wherein the inlets of the plurality of near wall cooling channels open into a common feeding channel for cooling air supply, and the outlets of the plurality of the near wall cooling channels open into a common discharge channel for cooling air discharge, the common feeding channel and the common discharge channel extending in the second direction, the common feeding channel being open at the first end and closed at the second end, the first end configured to receive supplied cooling air and guide the supplied cooling air into the inlets of the plurality of near wall cooling channels, and the common discharge channel being closed at the first end and open at the second end, the second end configured to discharge cooling air from the outlets of the plurality of near wall cooling channels, and wherein the common feeding channel and the common discharge channel each have a cross section which is constant in the second direction, and wherein the plurality of near wall cooling channels include a first channel located at the first end and a plurality of second channels located between the first channel and the second end, and wherein each of the plurality of second channels between the first channel and the second end has a smaller cross section than a respective closest upstream neighboring near wall cooling channel, with respect to a flow of the supplied cooling air.

2. The gas turbine part according to claim 1, wherein each of the plurality of near wall cooling channels are arranged within the at least one row with an essentially constant inter-channel distance.

3. The gas turbine part according to claim 1, comprising:

a plurality of rows of the plurality of near wall cooling channels, wherein the plurality of rows run parallel to each other in the second direction, each of the plurality of rows has a separate feeding channel and discharge channel with a common separation wall and respective outer channel walls, and wherein neighboring rows share an outer channel wall.

4. The gas turbine part according to claim 1, wherein each of the plurality of near wall cooling channels has a circular inlet and a circular outlet.

5. The gas turbine part according to claim 1, wherein the plurality of near wall cooling channels comprises at least three near wall cooling channels.

6. The gas turbine part according to claim 1, wherein the gas turbine part is a combustion liner.

7. A combustor liner of a gas turbine, comprising:

a wall, which is subjected to high temperature gas on a hot side, the wall containing a plurality of near wall cooling channels extending essentially parallel to each other in a first direction within the wall in close vicinity to the hot side and being arranged in at least one row extending in a second direction essentially perpendicular to the first direction, the at least one row having a first end and a second end, and wherein the plurality of near wall cooling channels are each provided at one end with an inlet for a supply of cooling air, and on another end with an outlet for a discharge of cooling air, wherein the inlets of the plurality of near wall cooling channels open into a common feeding channel for cooling air supply, and the outlets of the plurality of the near wall cooling channels open into a common discharge channel for cooling air discharge, the common feeding channel and the common discharge channel extending in the second direction, the common feeding channel being open at the first end and closed at the second end, the first end configured to receive supplied cooling air and guide the supplied cooling air into the inlets of the plurality of near wall cooling channels, and the common discharge channel being closed at the first end and open at the second end, the second end configured to discharge cooling air from the outlets of the plurality of near wall cooling channels, and wherein the common feeding channel and the common discharge channel each have a cross section which is constant in the second direction, and wherein the plurality of near wall cooling channels include a first channel located at the first end and a plurality of second channels located between the first channel and the second end, and wherein each of the plurality of second channels between the first channel and the second end has a smaller cross section than a respective closest upstream neighboring near wall cooling channel, with respect to a flow of the supplied cooling air; and the at least one row comprising a plurality of rows, wherein the plurality of rows run parallel to each other in the second direction, each of the plurality of rows has a separate feeding channel and discharge channel with a common separation wall and respective outer channel walls, and wherein neighboring rows share an outer channel wall.

8. The combustion liner according to claim 7, wherein each of the plurality of near wall cooling channels are arranged within the at least one row with an essentially constant inter-channel distance.

9. The combustion liner according to claim 7, wherein each of the plurality of near wall cooling channels has a circular inlet and a circular outlet.

10. The combustion liner according to claim 7, wherein the plurality of near wall cooling channels comprises at least three near wall cooling channels.

* * * * *